US006519820B1

(12) United States Patent
Bathelier

(10) Patent No.: US 6,519,820 B1
(45) Date of Patent: Feb. 18, 2003

(54) METHOD AND DEVICE FOR ORIENTING INDIVIDUAL FIBRES AND/OR FILAMENTS PRESENT IN A WEB

(75) Inventor: Xavier Bathelier, Saint-Pierrement (FR)

(73) Assignee: Tarkett Sommer S.A., Nanterre Cedex (FR)

( * ) Notice: Subject to any disclaimer, the term of this patent is extended or adjusted under 35 U.S.C. 154(b) by 0 days.

(21) Appl. No.: 10/031,242

(22) PCT Filed: Jul. 12, 2000

(86) PCT No.: PCT/EP00/06858

§ 371 (c)(1),
(2), (4) Date: Jan. 11, 2002

(87) PCT Pub. No.: WO01/04404

PCT Pub. Date: Jan. 18, 2001

(30) Foreign Application Priority Data

Jul. 12, 1999 (EP) ..... 99870152

(51) Int. Cl.[7] ..... D04H 1/74
(52) U.S. Cl. ..... 28/107
(58) Field of Search ..... 28/107, 108, 109, 28/110, 113, 114; 112/80.01

(56) References Cited

U.S. PATENT DOCUMENTS 3,705,063 A * 12/1972 Stumpf ..... 156/152
3,755,051 A * 8/1973 Stumpf ..... 156/242
5,239,734 A * 8/1993 Bathelier et al. ..... 28/107
5,867,880 A * 2/1999 Bathelier et al. ..... 28/107
6,012,205 A * 1/2000 Bathelier et al. ..... 28/107

FOREIGN PATENT DOCUMENTS

| | | |
|---|---|---|
| WO | WO 91/00382 | 1/1991 |
| WO | WO 96/10667 | 4/1996 |
| WO | WO 97/05315 | 2/1997 |
| WO | WO 98/36119 | 8/1998 |

* cited by examiner

*Primary Examiner*—Danny Worrell
(74) *Attorney, Agent, or Firm*—Knobbe, Martens, Olson & Bear, LLP

(57) ABSTRACT

The invention concerns a method for obtaining adequate orientation of elements constituting a web, such as fibres and/or filaments, for example derived from a card, characterized in that it consists in: subjecting the fibre to a pre-looping step produced by the interpenetration of a first set of looping discs (11) borne on a common transverse shaft (10) and continuously driven in rotation at a first speed (V1), and of a first set of fixed looping elements (12), the set of looping discs (11) and the set of looping elements (12) having a predetermined gauge (j) so as to cause the fibres and/or filaments to be pre-looped with an undulating value or interval (j), retaining with blocking means said fibres and/or filaments at regular intervals by a length (n×j) where n is an integer ranging between 2 and 20; allowing the pre-looped fibres and/or filaments to expand so as to produce large undulations having an undulating value or interval (n×j); and spreading by simple drawing the pre-looped fibres and/or filaments over an undulation value or interval (n×j). The present invention also concerns a device for implementing said method.

12 Claims, 8 Drawing Sheets

METHOD AND DEVICE FOR ORIENTING INDIVIDUAL FIBRES AND/OR FILAMENTS PRESENT IN A WEB

FIELD OF THE INVENTION

The present invention relates to an improved process and an improved device for orienting individual fibres and/or filaments present in a web, in particular derived from a card.

DESCRIPTION OF THE RELATED TECHNOLOGY

Usually, webs intended to be worked in order to obtain tufted, stitched, knitted or other products, are prepared by carding followed by drawing in a direction orthogonal to the outlet of the card. It is usually observed that the average orientation angle of the fibres in a web leaving the card is about ±5 degrees relative to the feed direction.

To modify the value of the angle, it might be proposed to draw said web. In this case, the value of the angle after drawing corresponding to the new orientation $\alpha$, which is defined orthogonally relative to the feed direction of the web, is given by:

$$tg(\alpha)=e\ tg(5°),$$

where e is the ratio of the widths of the web before and after transverse drawing.

Another possibility consists in proposing to carry out a passage through a spreading-lapping machine in order to produce a lap comprising several folds, as described, for example, in document EP-A-0 520 911. Preferably, this lapping step is carried out prior to the passage through a drawing machine.

Moreover, the Applicant has developed a particular technique known as the "verticalization technique" for producing textile products from a web of individual fibres and/or filaments. This technique has already been the subject of many publications since 1991, and has been described in particular in documents WO91/00382, WO96/10667, WO97/05315 and WO98/36119. It consists in proposing the preparation of a textile product directly from fibres and/or filaments travelling in the feed direction in the form of a web, this process comprising at least one step known as a "looping step" in which the fibres and/or filaments are individually submitted to a looping transversely relative to the feed direction of the web, optionally accompanied by a transverse drawing.

This technique allows to produce textile products intended for producing floorcoverings in the form of a tuft as described in document WO91/00382, the production of stitched products as described in document WO96/10667 or the production of lapped products as described in document WO98/36119.

Nevertheless, to work this verticalization technique, it is important for the starting web of fibres and/or filaments to have a low weight per unit area (preferably of between 10 and 50 g/m$^2$). Moreover, it is necessary for most of the constituent elements of the web, that is to say the fibres and/or filaments, to have an angle of orientation relative to the feed direction of the web of between 5 and 45 degrees, and preferably between 15 and 25 degrees.

With this aim, and in particular in document WO91/00382, a pre-drawing step has been included in order for the elements constituting the web (the fibres and/or filaments) to have the correct angle of entry before undergoing said verticalization step which consists in individually imparting to the constituent elements of the web transverse looping accompanied by drawing and followed by accumulation of said fibres and/or filaments which have been parallelized in a particularly satisfying manner in the form of loops so as to make a pseudo-yarn.

The pre-drawing step consists in passing a web of low surface density into a set of interpenetrating discs which oblige the web, optionally derived from the card, to undergo looping over a width greater than that of the product to be made. The fibres are then left to recover, by resilience, a flat position which they obtain by stretching widthwise, allowing the fibres to pivot towards a new orientation.

As described in document WO91/00382, this pre-drawing step consists in submitting the web to a set of discs spaced apart by a distance j (gauge), which are arranged on two shafts. The discs on the two shafts are positioned in a staggered arrangement relative to each other and interpenetrate over a distance d which allows the amplitude of the looping and thus the drawing value to be defined, i.e. $e=2j/d$ and thus allows $\alpha$ to be defined.

The device described in the prior art has proved itself and demonstrated its efficiency in an industrial context. Nevertheless, a certain number of drawbacks remain, in particular:

- In the case of a high value of e: in this case, the resilience of the fibres reaches its limit. Beyond e=2, the undulations have a tendency to be converted into folds and to persist in the drawn web, thus creating irregularities.
- In the case of large working widths: for widths greater than 4 m, an undulation generated at the centre of the web can only be "relaxed" by pushing its neighbours. In this case, the intrinsic resilience of the fibres contained in a single undulation will be insufficient to push the entire width of the web. It also depends greatly on the type and nature of the fibres used.
- When it is desired to obtain a value of e which can be modulated over the width of the web, which may prove to be very useful when it is desired to correct the weight curves of the web: specifically, the web has a tendency to be slightly heavier at the centre than on the sides.
- When it is desired to generate webs starting with elements that are very narrow, such as tapes, filaments or cables.

SUMMARY OF CERTAIN INVENTIVE ASPECTS

Firstly, the present invention aims to propose a solution for modifying the width of the web, optionally derived from the card.

More particularly, the present invention aims to propose a web which will undergo the verticalization process and in which the individual fibres and/or filaments have the appropriate orientation.

The present invention aims also to allow, besides an appropriate orientation of the fibres within said web, an isotropic orientation of said fibres.

Finally, the present invention aims additionally to allow the production of a web which has a condensation of fibres, in particular in the case of a preparation of a dense product.

The present invention relates to a process for obtaining an appropriate orientation of constituent elements of a web, such as fibres and/or filaments, for example derived from a card, characterized in that:

- the fibres and/or filaments are submitted to a pre-looping step carried out by means of the interpenetration of a first set of looping discs carried on a common transverse shaft and driven in continuous rotation at a first speed, and of a first set of fixed looping elements, the set of looping discs and the set of looping elements having a defined gauge j so as to cause the fibres and/or filaments to be pre-looped with an undulation value or period j, with the aid of blocking means, said fibres and/or filaments are held at regular intervals of a length of (n×j) where n is an integer between 2 and 20, the pre-looped fibres and/or filaments are allowed to expand so as to produce large undulations with an undulation value or period (n×j), and the pre-looped fibres and/or filaments are spread by simple transverse drawing over an undulation value or period (n×j).

The present invention also relates to the device for carrying out this process, characterized in that it comprises:

a first set of looping discs carried on a common transverse shaft and driven in continuous rotation at a first speed, a first set of fixed looping elements, the set of looping discs and the set of looping elements having a defined gauge (j) so as to cause the fibres and/or filaments to be pre-looped with an undulation value or period (j), blocking elements regularly arranged with a gauge (n×j) where n is an integer between 2 and 20, which are intended to block the pre-looped fibres and/or filaments over an undulation value or period (j) at regular intervals of a length (n×j), and a spreading conveyor for flattening out the fibres and/or filaments.

Preferably, said looping elements of the device are looping fingers.

According to a first embodiment, said blocking elements consist of looping fingers that are longer than the other looping fingers and are present every 2 to 20 consecutive looping fingers.

According to a second embodiment, these blocking elements consist of another set of detaching discs carried on a common transverse shaft and driven in continuous rotation at a speed corresponding to the rotation speed of the looping discs.

Advantageously, in this embodiment, the detaching discs are arranged in the extension of some of the looping fingers.

Advantageously, the spreading conveyor consists of a set of individual belts arranged divergently, and the number of these individual belts preferably corresponds substantially to the number of blocking elements.

Advantageously, the blocking elements penetrate slightly between the various individual belts.

Preferably, mechanical means are provided to vary the longitudinal speeds of the belts slightly, such that the travelling speed at any transverse point of the web is equivalent for all the belts.

Advantageously, the device of the invention also comprises means for condensing the fibres and/or filaments arranged upstream the first set of looping discs and the first set of fixed looping elements.

These fibre-condensing means preferably consist of a second set of looping discs carried on a second common transverse shaft and driven in continuous rotation at a speed and between which are arranged fixed looping elements forming a second set of looping elements. The second set of looping discs and the second set of fixed looping elements have the same gauge as the first set of looping discs and the first set of fixed looping elements, and the rotation speed of the second set of looping discs is greater than that of the first set of looping discs.

DETAILED DESCRIPTION OF CERTAIN INVENTIVE EMBODIMENTS

The present invention has been described with reference to the verticalization techniques described more particularly in the Applicant's prior publications, and in particular in publications WO91/00382 and WO98/36119.

The principle upon which the present invention is based is thus directed towards preparing the web of fibres and/or filaments, and more particularly towards adjusting the angle of said individual fibres and/or filaments of the web which will be submitted to the looping-drawing step as described in details in the various prior publications.

However, the process described in the present invention can also be used to make webs intended for conventional needling, calendering, chemical consolidation or ultrasonic consolidation techniques as described abundantly in the prior art.

More particularly, the process upon which the present invention is based may allow the production of webs with a weight varying within the standard range from 10 to 50 g/m$^2$ up to values from 100 to 300 g/m$^2$, and may do so without difficulty.

Similarly, the process upon which the present invention is based may allow the production of webs with a variable width ranging from 0.5 to several meters, without difficulty.

Contrary to the disclosure given in publication WO91/00382, in which it was proposed to carry out the pre-looping by means of interlocking a first set of discs arranged on a first shaft and a second set of discs arranged on a second shaft, the present invention proposes to produce an appropriate orientation of the constituent elements of the web by pre-looping by means of a set of looping discs arranged on a first shaft and driven in rotation at a continuous speed, which co-operate with looping fingers which are fixed and whose profile allows the material to be engaged and then driven. After this pre-looping, the constituent elements of the web, namely the fibres and/or filaments, are uniformly retained by blocking means, and these pre-looped fibres and/or filaments are allowed to expand so as to obtain fibres and/or filaments with larger undulations. These large undulations are then spread.

Figure 1:
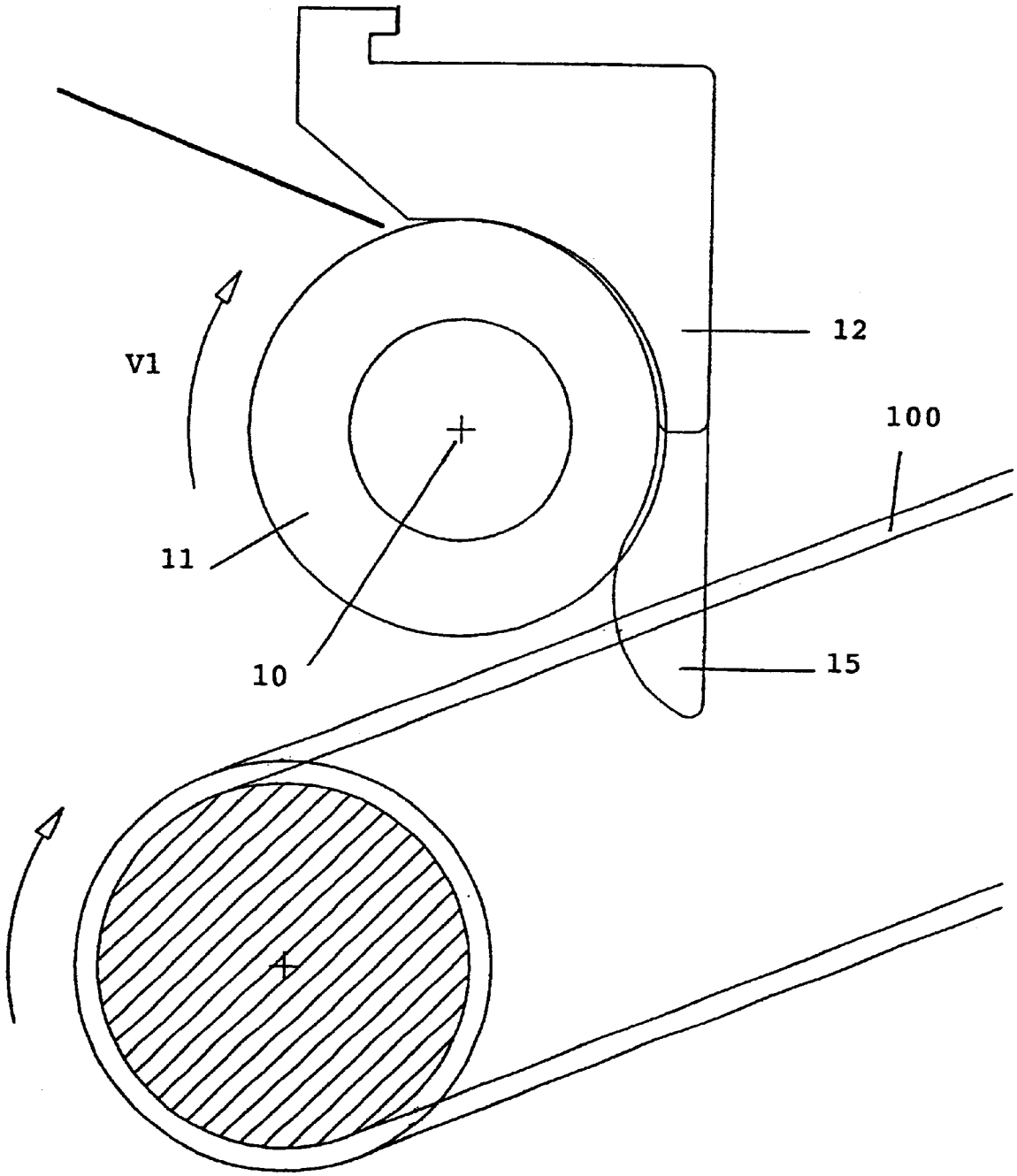
FIG. 1 shows a cross section view of the device according to a first embodiment for carrying out the process according to the present invention.
Figure 2:
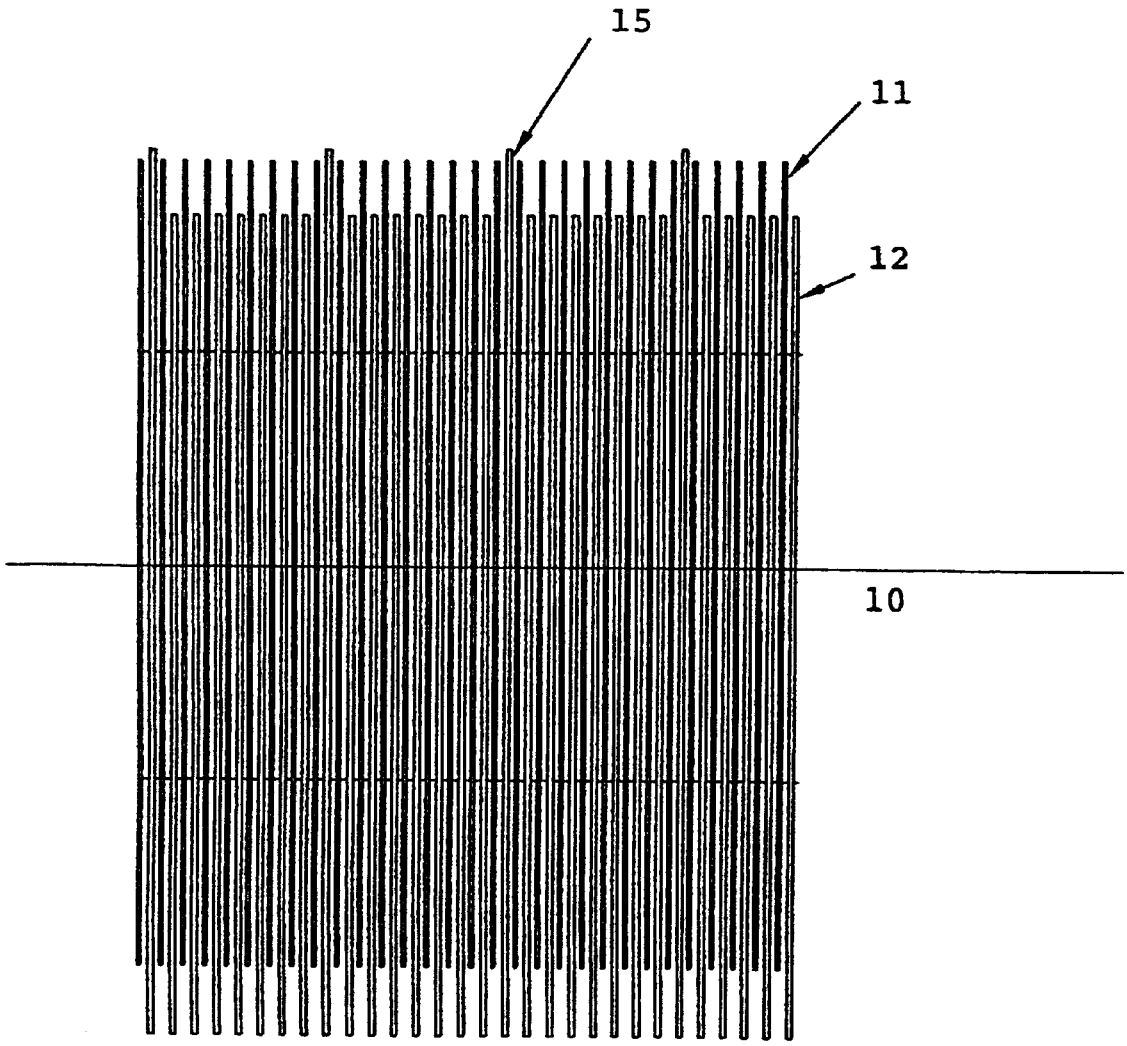
FIG. 2 shows a top view of the device as shown in FIG. 1.

FIGS. 1 and 2 show cross-section and top views of a first embodiment of a device for carrying out the pre-looping process according to the present invention allowing the orientation of the individual fibres and/or filaments present in a web. This device comprises a first set of looping discs 11 arranged in a gauge j on a first common transverse shaft 10 and between which are arranged fixed looping fingers 12 constituting a first set of looping elements. The looping discs 11 are driven in rotation at a continuous and preferably constant speed, while the looping fingers 12 are fixed.

Advantageously, according to this first embodiment, it is proposed to regularly arrange a fixed looping finger 15 which is longer than the other looping fingers 12 every 2 to 20 looping fingers 12, preferably every 3 to 10 looping fingers 12, that is to say with a gauge (n×j) in which 2≦n (integer)≦20.

In this way, the presence of the longer looping finger 15 will appear at regular intervals, that is to say every (2×j) to (20×j). These longer looping fingers 15 thus constitute the the blocking elements defined above.

Figure 3:
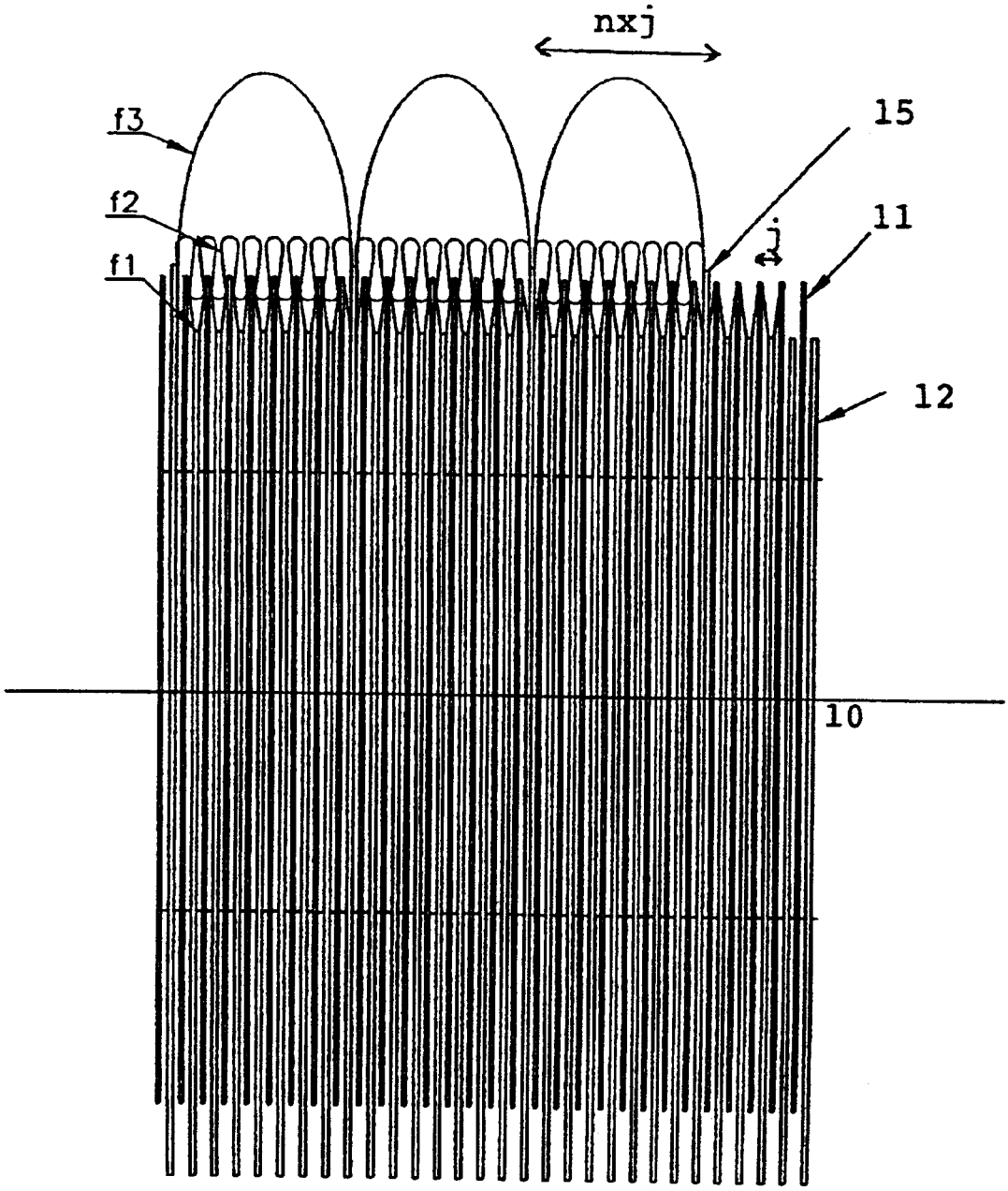
FIG. 3 shows a top view of the device as shown in FIG. 1 and in which the fibres and/or filaments which have undergone the pre-looping steps have been shown.

FIG. 3 describes three successive fibres f1, f2 and f3 driven by the device according to this first embodiment. The various successive steps to which these three fibres f1, f2 and f3 are submitted at different times in the progression of the web through the device are clearly observed.

Specifically, it is noted that the fibres f1 which have just been (pre)looped by the system of short looping fingers 12/looping discs 11 are still maintained under tension between the short looping fingers 12 and the looping discs 11 in the form of small undulations with an undulation value or period j. The looping discs 11 continue to push the fibres f1 until they leave the end of the short looping fingers 12. At this moment, since the fibres f1 are no longer under tension, they will seek to expand by the effect of their resilience and to take the shape of the fibres as represented by f2, without, however, leaving the looping discs 11. The period of the fibres f2 remains j.

By virtue of the cohesion between the fibres of the web, the fibres such as the fibres f2 will be pulled out of the looping discs 11 by the fibres arranged downstream and will be able to expand fully while at the same time being maintained within the limits of the long looping fingers 15 serving as blocking means, as represented for the fibres f3. At this stage, large undulations with an undulation value or period (n×j), in which n is the frequency at which the long looping fingers 15 are arranged between the short looping fingers 12, have been made. n is thus an integer between 2 and 20.

The gauge j, that is to say the distance between two looping discs 11 or two consecutive short looping fingers 12, is preferably small, that is to say between 2 and 15 mm and more particularly between 5 and 10 mm. This makes it possible to ensure more uniform drawing. Starting with a relatively small gauge j makes it possible to draw the web very uniformly and homogeneously, which would not have been possible if the gauge corresponding to the long looping fingers 15, that is to say the gauge (n×j), had been used as the looping gauge.

Figure 4:
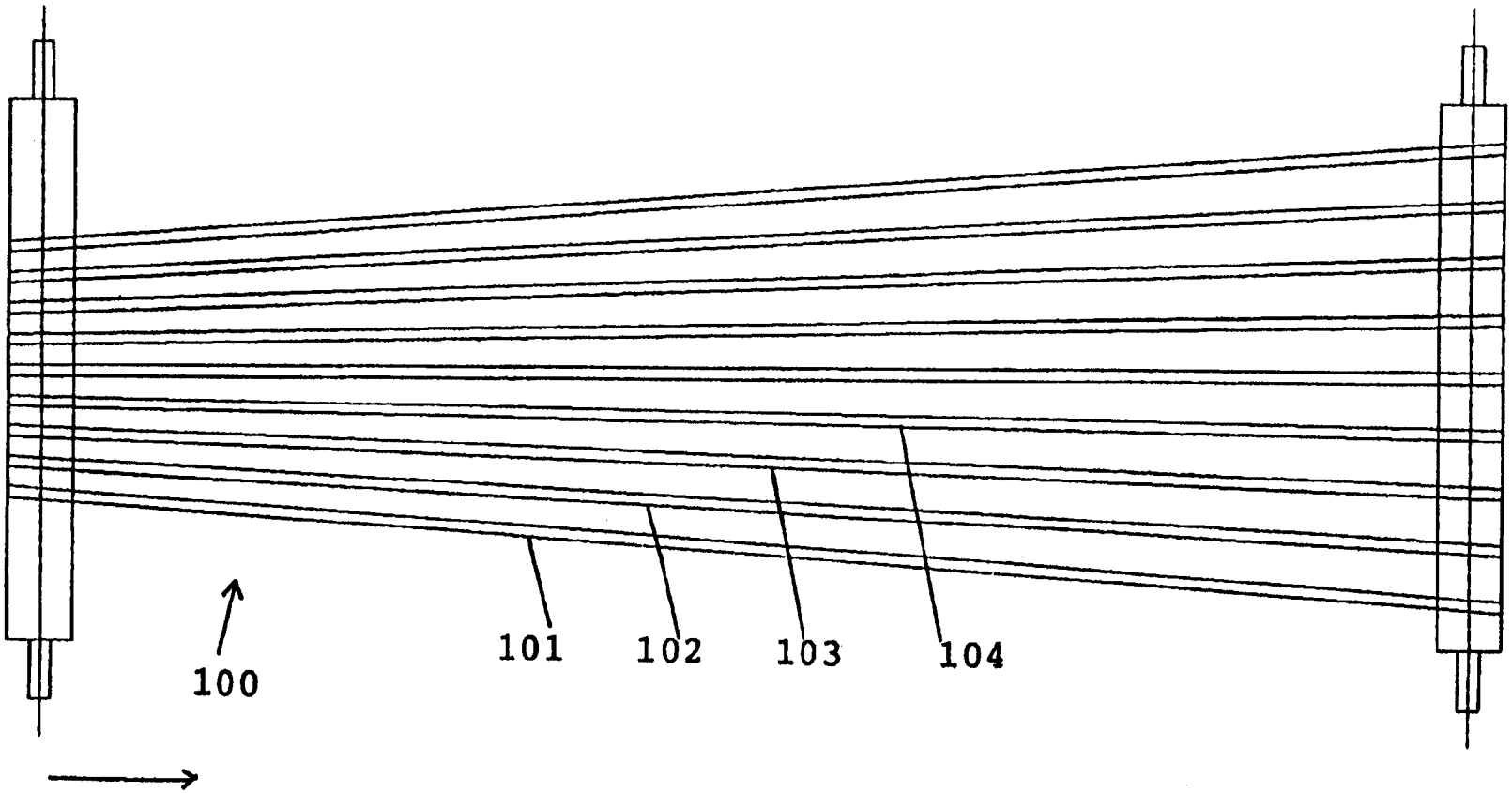
FIG. 4 shows a top view of the spreading conveyor for drawing the fibres and/or filaments, which is present in the devices shown in FIGS. 1, 2 and 3.

The large undulations of period (n×j) are conveyed towards the spreading conveyor 100 which is in the form of several straps or belts 101, 102, 103, etc. of any cross section, and which allow the fibres to be collected by gravity or even by means of gentle suction, on leaving the longest fingers 15. These straps or belts 101, 102, 103, etc. are arranged divergently, as shown in FIG. 4, and thus spread out in the plane of the web and hence make it possible to accompany the undulations while at the same time controlling their flattening.

Judiciously, the long looping fingers 15 extend between the belts or straps 101, 102, 103, etc.

Preferably, the number of long looping fingers 15 is equivalent to the number of straps.

Proposing a spreading conveyor which is in the form of belts advantageously makes it possible to totally flatten the web and thus widen it.

In a particularly advantageous manner, it will be appropriate to provide suitable mechanical means which make provision such that the longitudinal component (that is to say the component in the feed direction of the belt) of each belt is slightly different, such that the travelling speed at each transverse point in the web is equivalent.

By virtue of the intrinsic cohesion of the web, the downstream fibres already present between the belts will drive the fibres located on the long looping fingers 15. This device has the advantage of simplifying the general device but, however, requires the presence of a sufficiently cohesive (and thus sufficiently heavy) web.

Figure 5:
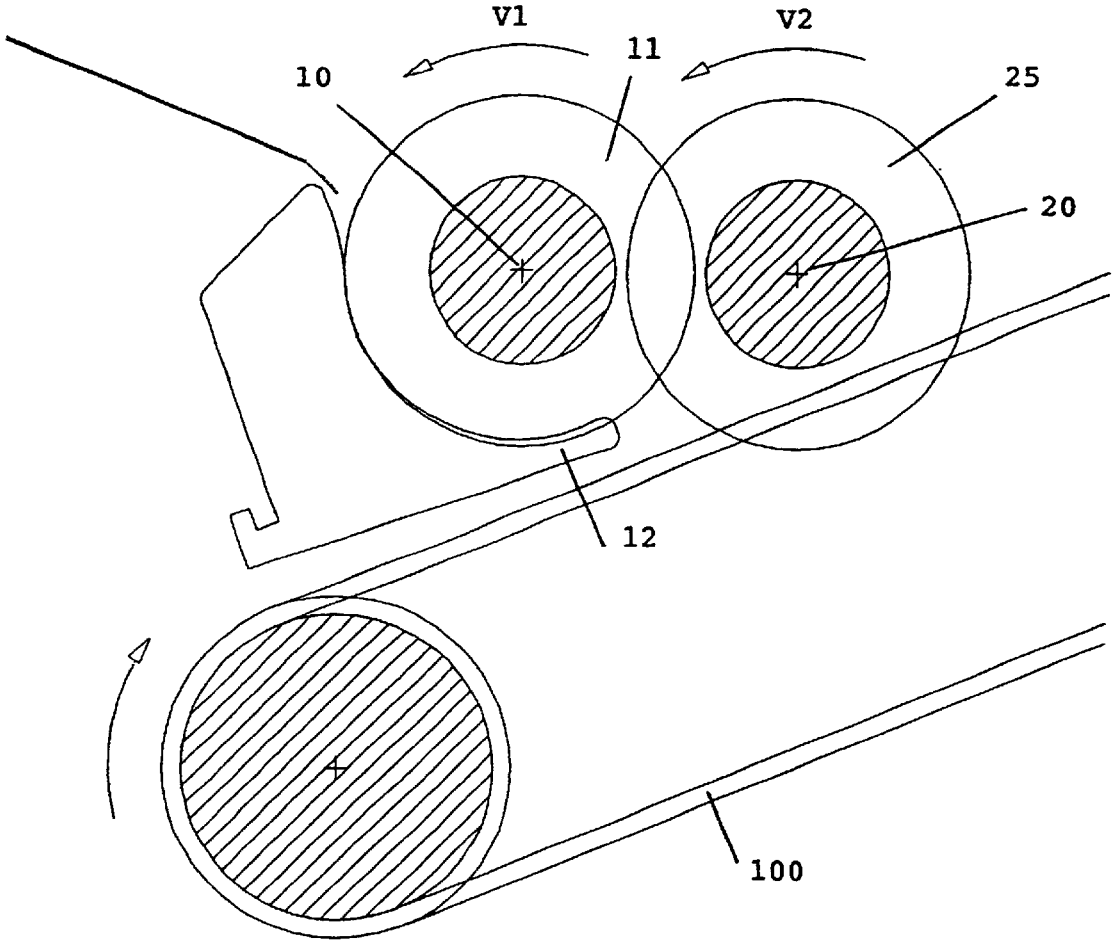
FIG. 5 shows a cross section view of the device according to a second embodiment for carrying out the process according to the present invention.
Figure 6:
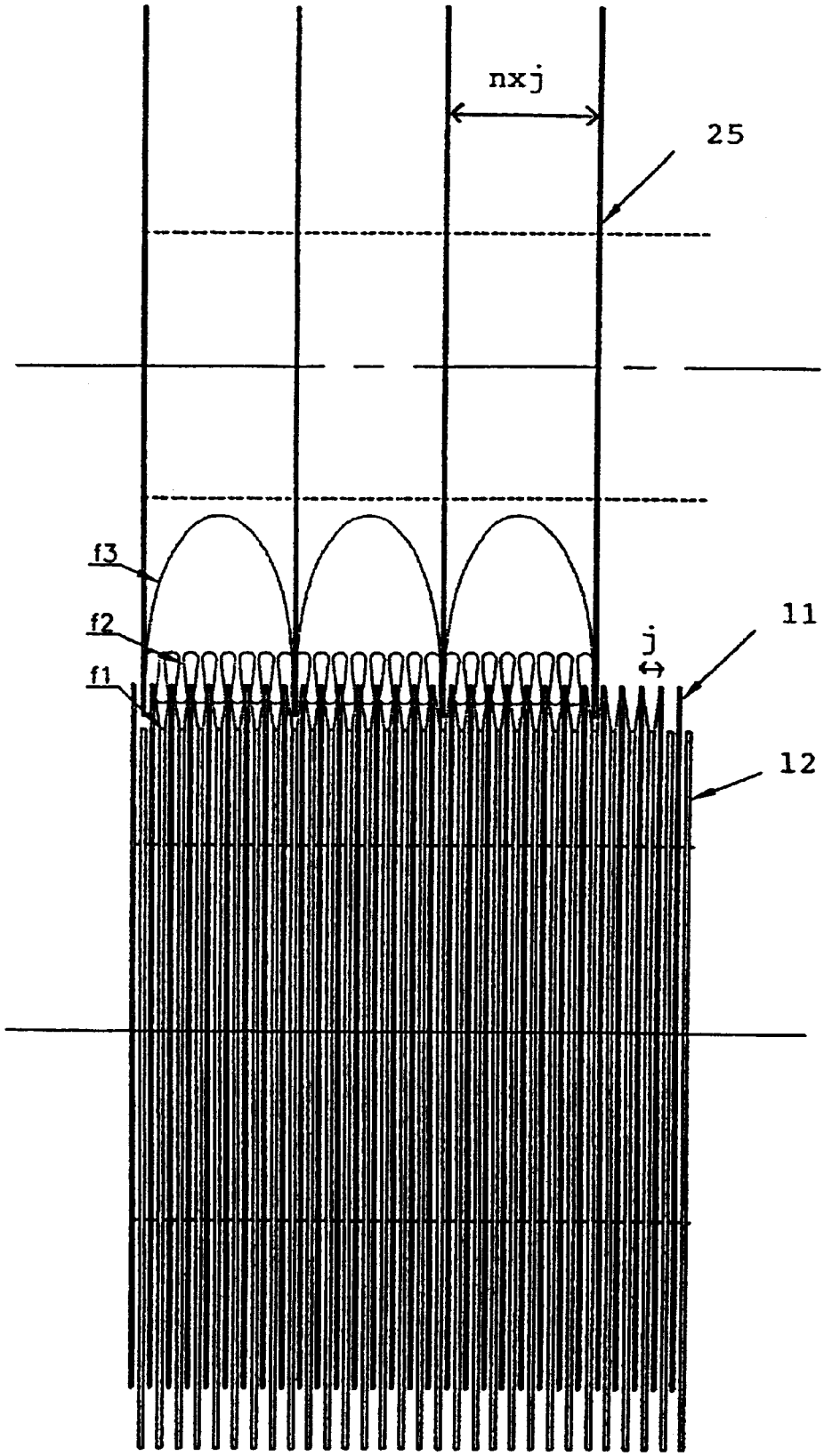
FIG. 6 shows top views of the device as shown in FIG. 5 and in which the fibres and/or filaments which have undergone the pre-looping steps are shown.

According to another preferred embodiment, the process according to the present invention may be carried out with the device described in FIGS. 5 and 6. This device firstly comprises a first set of looping discs 11 carried on a first common transverse shaft 10 and driven in continuous rotation at a first speed V1, between which is arranged a set of short looping fingers 12. This first set of discs 11 and this set of looping fingers 12 have a gauge j. Downstream this set of looping discs 11 and in the extension of some of the looping fingers 12 is arranged another set of discs 25 also carried on a common transverse shaft 20 parallel to the first shaft 10.

This other set of discs 25 is known as a set of "detaching discs" and has a gauge (n×j) in which n is an integer between 2 and 20. Specifically, a detaching disc 25 has been arranged at regular intervals in the extension of some of the looping fingers 12 every (n×j) looping fingers 12.

The detaching discs 25 are also driven in continuous rotation at a speed V2 equivalent to the speed V1 of the first looping discs 11, and in the same direction.

The formation of the undulations of the fibres is described in FIG. 6 and corresponds exactly to that which has been described previously in relation to FIG. 3, the only difference being that the role played by the long looping fingers 15 is this time played by the detaching discs 25.

In this case, the detaching discs 25 rotating in the same direction as the looping discs 11 will detach the undulations of the first set of looping discs 11 and convey them positively to the spreading conveyor 100 which is composed of several slightly divergent belts 101, 102, 103, etc., as shown in FIG. 4.

Advantageously, the detaching discs 25 penetrate slightly between the belts 101, 102, 103, etc.

The large undulations are flattened out simply by the divergent belts at the same time that the web finds its new width.

Once again, the number of detaching discs corresponds to the number of belts.

By using such devices, it is understood that the lack of resilience of the fibres arranged in the web at the outlet of the card after they have undergone looping can be compensated for by performing higher drawing, and by doing so in a single step. By individual adjustment of the penetration of the fingers inside the discs and also by variable adjustment of the spreading angles of the belts, the draw value can be modulated by increments and the weight curves of the web can thus be corrected.

Furthermore, by varying the gauge and by suggesting a finer gauge, and also by proposing particular belts, it is possible to draw constituent elements of the web which may be fibres, filaments and even tapes or large yarns of low width.

By deliberately selecting a very fine gauge, tapes of continuous filaments can be drawn while breaking them so as to obtain fibres whose average length will depend on the gauge.

Figure 7:
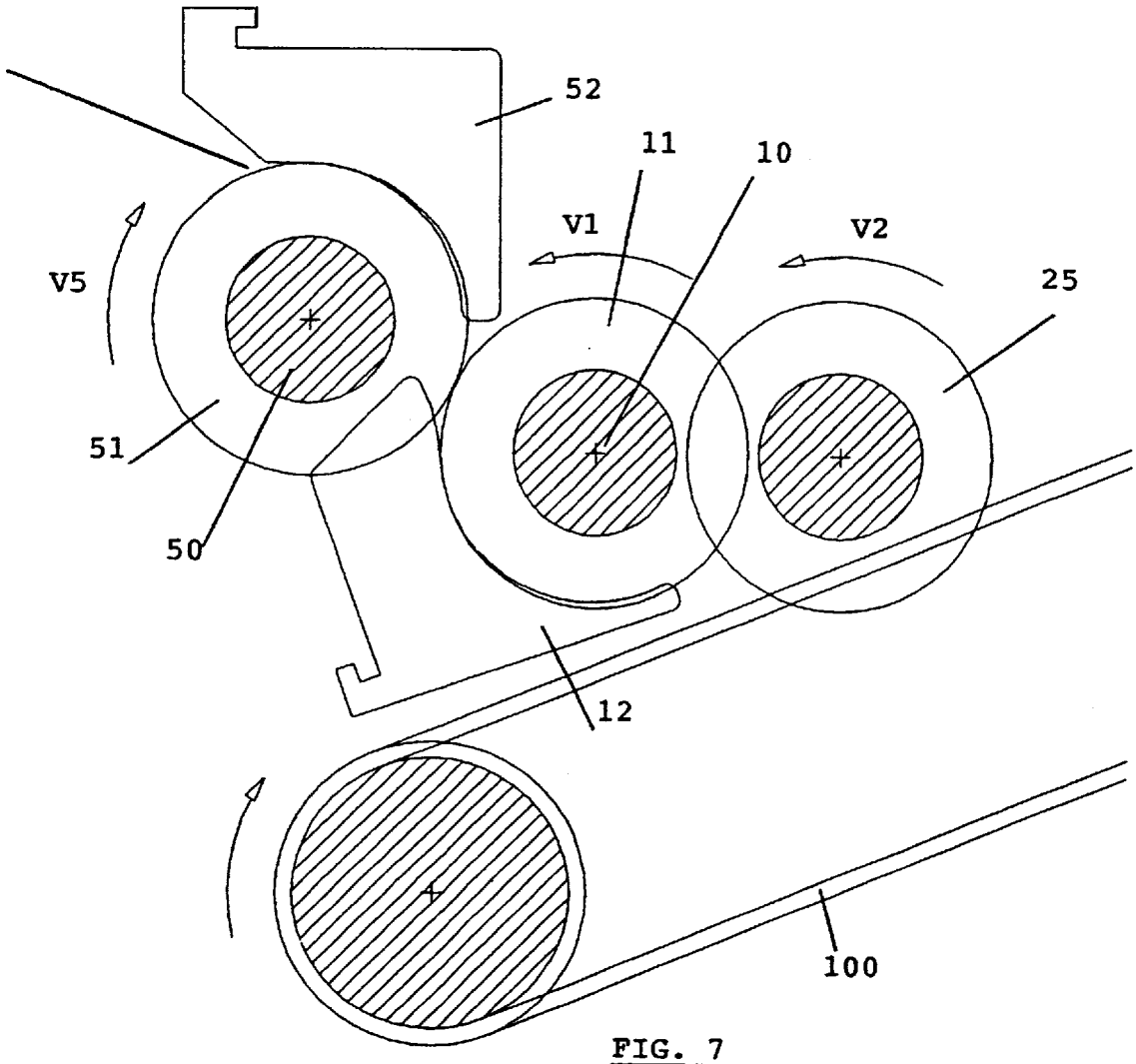
FIG. 7 shows a cross section view of one particular device for advantageously carrying out the process according to the present invention, intended for producing "condensed" products.

FIG. 7 shows a variant of the device described in FIG. 5 and which makes it possible to produce the condensation of fibres and/or filaments in order to produce a thicker mattress. In particular, such a device make it possible to obtain a degree of condensation which may be up to 500%, whereas the conventional devices at the most reach values of the order of 80%.

According to the present invention, and as shown in FIG. 7, the device comprises, upstream the first set of looping discs 11 carried on a first common transverse shaft 10, driven in continuous rotation at a speed V1, and between which are arranged looping fingers 12 forming a first set of looping elements 12, a second set of looping discs 51 carried on a second common transverse shaft 50, driven in continuous rotation at a speed V5, and between which are arranged fixed looping elements 52 which form a second set of looping elements.

These two sets of looping discs 11 and 51 have a gauge j. As described above, this first set of looping discs 11 is combined with a set of detaching discs 25 but which have a gauge (n×j).

In order to carry out the condensation of the fibres, the driving speed V5 of the second set of looping discs 51 is greater than the driving speed V1 of the first set of looping discs 11. This makes it possible to "condense" the fibres and thus to accumulate them before they are driven by the set of looping discs 11/looping fingers 12.

In this way, a mattress of any weight, ranging up to values of 300 g/m$^2$, may be produced, and may be used in calendering, lapping, chemical consolidation, ultrasonic consolidation, etc. techniques.

It should be noted that the condensation device shown in FIG. 7 might also be used with the first preferred embodiment of the invention described above, that is to say the one using the long looping fingers 15 as blocking elements.

Figure 8:
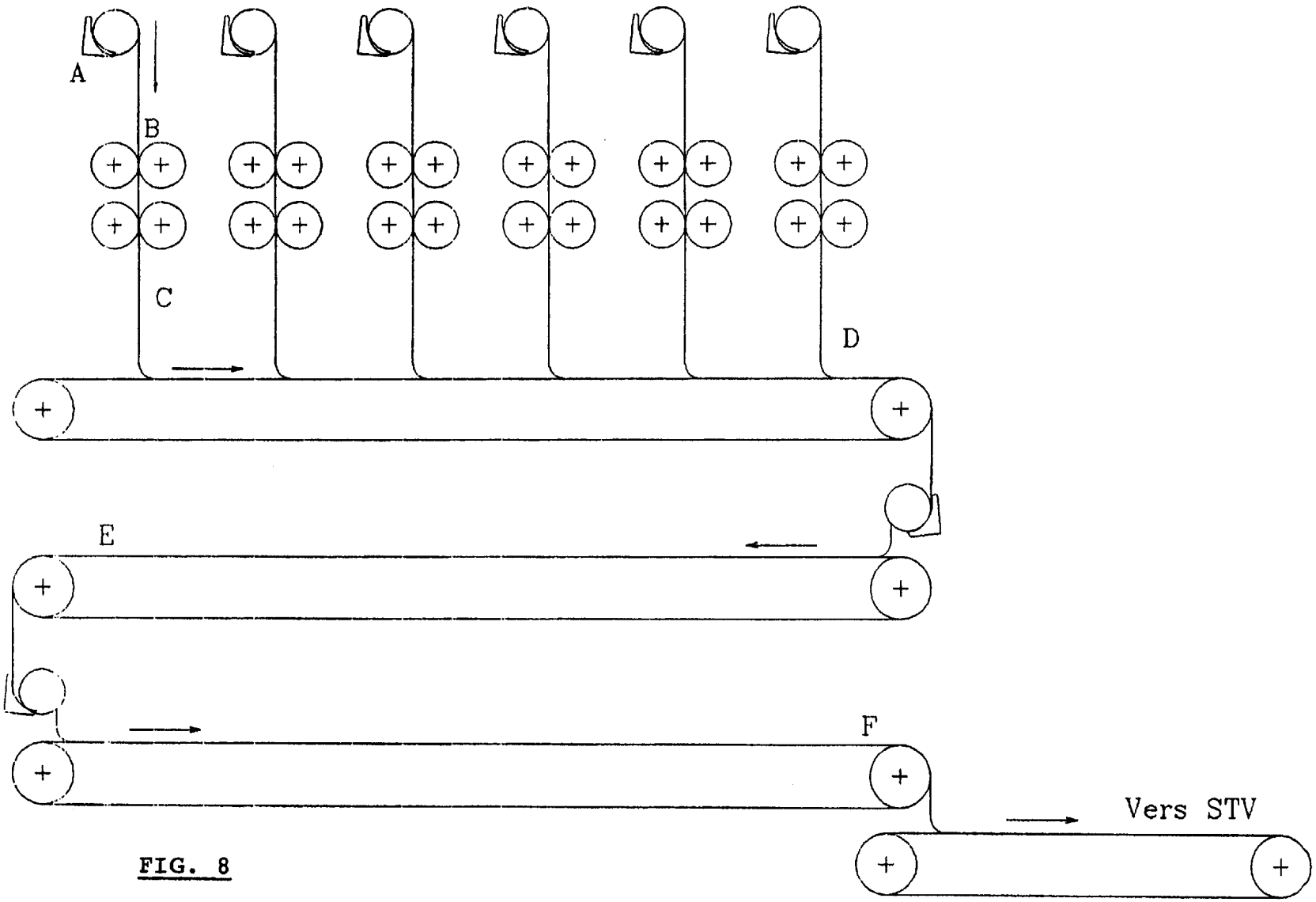
FIG. 8 shows a complete device for producing a specific product based on tapes for producing a product of brushed-bonded type.

As an illustrative example, FIG. 8 describes a device for producing a particular example of a product of "brushed-bonded" type obtained from six tapes of 25 kTex which make it possible directly to generate a web of fibres of 23 g/m$^2$ over a width of 1.80 m. This web will then be submitted directly to the device as described in the prior applications and known as the "verticalization" device.

| Steps | No of tapes | Longit. drawing | Transv. drawing | Weight per unit area | Width | Angle |
|---|---|---|---|---|---|---|
| A | 1 | 1 | 1 | 250 g/m$^2$ | 0.1 m | 5° |
| A to B | 1 | 1 | 3 | 83 g/m$^2$ | 0.3 m | 15° |
| B to C | 1 | 3 | 1 | 28 g/m$^2$ | 0.3 m | 5° |

-continued

| Steps | No of tapes | Longit. drawing | Transv. drawing | Weight per unit area | Width | Angle |
|---|---|---|---|---|---|---|
| C to D | 6 | 1 | 1 | 167 g/m$^2$ | 0.3 m | 5° |
| D to E | 6 | 1 | 3 | 57 g/m$^2$ | 0.9 m | 15° |
| E to F | 6 | 1 | 2 | 23 g/m$^2$ | 1.8 m | 28° |

What is claimed is:

1. A process for obtaining an appropriate orientation of constituent elements of a web, the process comprising the acts of:

providing fibers or filaments to a pre-looping step carried out by interpenetration of a first set of looping discs carried on a common transverse shaft and driven in continuous rotation at a first speed, and of a first set of fixed looping elements, the first set of looping discs and the first set of fixed looping elements having a defined gauge so as to cause the fibers or filaments to be pre-looped with an undulation value or period;

holding said fibers or filaments with blocking elements at regular intervals of n×j, where n is an integer between 2 and 20 and j is the undulation value or period;

permitting the pre-looped fibers or filaments to expand so as to produce large undulations with an undulation value or period of n×j; and spreading the pre-looped fibers or filaments by drawing over the undulation value or period of n×j.

2. A device for obtaining an appropriate orientation of constituent elements of a web carrying, comprising:

a first set of looping discs carried on a common transverse shaft and driven in continuous rotation at a first speed;

a first set of fixed looping elements, said looping elements being arranged between said first set of looping discs, the first set of looping discs and the first set of looping elements having a defined gauge so as to cause the fibers or filaments to be pre-looped with an undulation value or period;

blocking elements regularly arranged with a gauge n×j where n is an integer between 2 and 20 and j is the undulation value, said blocking elements being configured to block the pre-looped fibers or filaments over an undulation value or period at regular intervals of n×j; and a spreading conveyor for flattening out the fibers or filaments.

3. The device according to claim 2, wherein the looping elements are first and second looping fingers.

4. The device according to claim 3, wherein the blocking elements include the first looping fingers which are longer than the second looping fingers and which are present every 2 to 20 consecutive second looping fingers.

5. The device according to claim 3, wherein the blocking elements include detaching discs carried on a common transverse shaft and driven in continuous rotation at a speed corresponding to the rotation speed of the looping discs.

6. The device according to claim 5, wherein the detaching discs are arranged in an extension of predetermined looping elements.

7. The device according to claim 2, wherein the spreading conveyor includes a set of individual belts that are arranged divergently.

8. The device according to claim 7, wherein the number of individual belts corresponds substantially to a number of blocking elements.

9. The device according to claim 8, wherein the blocking elements penetrate between the individual belts.

10. The device according to claim 7, wherein mechanical means are provided to vary longitudinal speeds of the belts such that a travelling speed at any transverse point in the web is equal for all belts.

11. The device according to claim 2, further comprising a condensing device configured to condense the fibers or filaments arranged upstream the first set of looping discs and the first set of fixed looping elements.

12. The device according to claim 11, wherein the condensing device includes a second set of looping discs carried on a second common transverse shaft and driven in continuous rotation at a second speed and between which are arranged fixed looping elements forming a second set of looping elements, the second set of looping discs and the second set of fixed looping elements having the same predetermined gauge as the first set of looping discs and the first set of fixed looping elements, the rotation speed of the second set of looping discs being greater than that of the first set of looping discs.

* * * * *